United States Patent [19]

Doss et al.

[11] 4,101,822

[45] Jul. 18, 1978

[54] INSTRUMENT FOR TESTING A BREAKERLESS IGNITION SYSTEM

[75] Inventors: Daniel L. Doss; Robert A. Melander, both of Owatonna, Minn.

[73] Assignee: Owatonna Tool Company, Owatonna, Minn.

[21] Appl. No.: 781,510

[22] Filed: Mar. 25, 1977

[51] Int. Cl.[2] ..... F02P 17/00

[52] U.S. Cl. ..... 324/16 R

[58] Field of Search ..... 324/16 R, 15, 17, 73 R

[56] References Cited

U.S. PATENT DOCUMENTS

| | | | |
|---|---|---|---|
| 3,028,543 | 4/1962 | Parmater et al. | 324/16 R |
| 3,424,979 | 1/1969 | Stocker | 324/73 |
| 3,521,155 | 7/1970 | Zdral | 324/15 |
| 3,596,174 | 7/1971 | Hovenga | 324/17 |
| 3,961,240 | 6/1976 | Pohl | 324/16 R |
| 4,006,403 | 2/1977 | Olsen et al. | 324/16 R |

*Primary Examiner*—Stanley T. Krawczewicz

*Attorney, Agent, or Firm*—Wegner, Stellman, McCord, Wiles & Wood

[57] ABSTRACT

A method of and an instrument for testing a breakerless ignition system for an internal combustion engine. The instrument, a self-contained portable unit, is coupled to the breakerless ignition system and several reference voltages are established. The voltage from the battery of the ignition system is compared with one of the reference voltages and an indication is provided if the voltage from the battery is sufficient to operate the breakerless ignition system. The DC voltage provided to the coil of the breakerless ignition system is compared to two established reference voltages and an indication is provided if the DC voltage provided to the coil is within an established range. Also, the width of the pulses to the coil, which pulses are ultimately used to generate the spark for the internal combustion engine, is measured and an indication is provided if the width of the pulses is sufficient to sustain a spark. A simulator circuit is provided to simulate a signal representative of the signal obtained by the rotation of a timing cam as the timing cam traverses a magnetic sensor.

16 Claims, 3 Drawing Figures

| | IGNITION SWITCH OFF | IGNITION SWITCH ON | IGNITION SWITCH START | IDLE | SIMULATE |
|---|---|---|---|---|---|
| V-BATT (68) | ON | ON | | ON | ON |
| V-COIL (84) | ON | ON | | ON | |
| V-COIL (96) | | ON | ON | ON | ON |
| V-AMP (112) | | | ON | ON | ON |

INSTRUMENT FOR TESTING A BREAKERLESS IGNITION SYSTEM

BACKGROUND OF THE INVENTION

This invention relates to measuring and testing and, more particularly, to an instrument for and a method of testing a breakerless ignition system for an internal combustion engine.

Breakerless ignition systems of the type disclosed in U.S. Pat. No. 3,831,570 are becoming increasingly employed in automobiles and other vehicles. These systems are extremely complex, are usually packaged in a single amplifier module, and are difficult for even a skilled mechanic to check and test. It is desirable to test the breakerless ignition system and it is even more desirable to be able to test the operation of the system when the system is coupled to the internal combustion engine.

Accordingly, we have developed an instrument for testing a breakerless ignition system which, when coupled to the system, is capable of providing an indication as to whether or not the system is functioning properly. The instrument is portable, self-contained, does not require any auxiliary power supply, and the method of testing the ignition system is easily accomplished with the instrument.

SUMMARY OF THE INVENTION

A breakerless ignition system of an internal combustion engine generally employs a battery, an ignition switch, an amplifier module, a coil, a distributor and spark plugs. The amplifier module provides a DC voltage to the coil as well as output pulses to the coil in response to the rotation of a timing cam. The coil provides high voltage pulse to the distributor which distributes the high voltage pulses to the spark plugs of the engine. The instrument is connected to various points within the system and measurements are taken. Various system voltages are compared with reference voltages established by the instrument to assure proper operation, and the pulse amplitude of the pulses provided to the coil is measured during testing. The instrument includes a simulator circuit for simulating a signal representative of a signal obtained by the rotation of the timing cam of the internal combustion engine.

It is a principal feature of the present invention to provide an instrument for testing a breakerless ignition system.

Another feature of the present invention is to provide an instrument that is portable, self-contained and does not require an auxiliary power supply, other than vehicle battery.

Yet another feature of the present invention is to provide an instrument which gives a visual indication of the operability of the breakerless ignition system and is easily operated by a mechanic.

Another feature of the present invention is to provide a testing method which, when completed, assures that the breakerless ignition system is operating properly.

These and other principal features of the invention will become apparent when considering the specification in combination with the drawing in which:

DRAWING

DESCRIPTION OF PREFERRED EMBODIMENTS

Figures 1, 3:
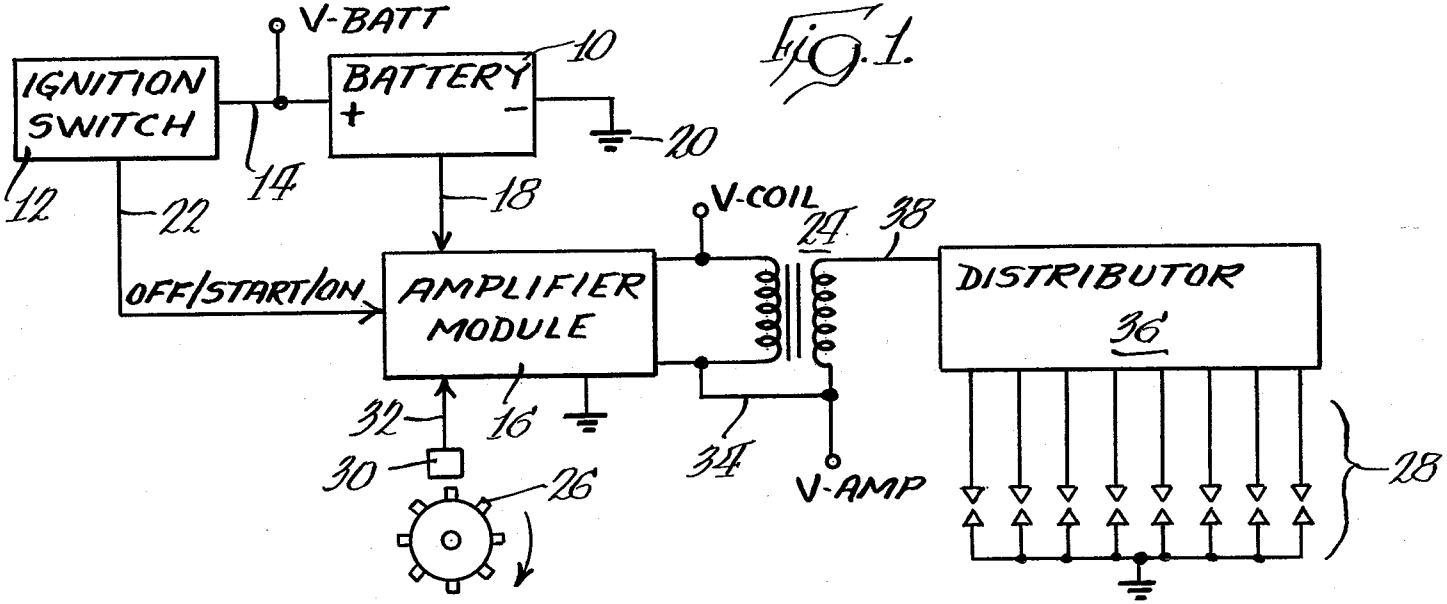
FIG. 1 is a block diagram of a typical breakerless ignition system.
FIG. 3 is a chart useful in considering the method of testing the breakerless ignition system of FIG. 1.

Referring to FIG. 1, a block diagram of a breakerless ignition system is shown. The system includes battery 10 which is coupled to the ignition switch 12 by way of line 14 and to the amplifier module 16 by way of line 18. The negative terminal of the battery 10 is coupled to ground 20, usually the chassis of the vehicle. Although battery 10 is shown to be connected such that its negative terminal is connected to the vehicle, it should be understood that the positive terminal of the battery could be connected to ground, in which event the polarity of other circuit elements within the system would also be reversed. The ignition switch 12 establishes the operating conditions of the amplifier module 16 by information provided on line 22. Specifically, line 22 controls OFF, START and ON of the internal combustion engine and the amplifier module 16. The amplfier module 16 may be of the type described in U.S. Pat. No. 3,831,570, and develops and provides output pulses to coil 24 in response to the detection of the lobes of the rotating timing cam 26. The rotating timing cam 26, mechanically coupled to the internal combustion engine, determines when a pulse is to be provided to spark plugs 28. Specifically, as timing cam 26 rotates in the manner shown, the lobes traverse the face of the magnetic sensor 30. A detection of a lobe by the magnetic sensor 30 is provided to the amplifier module 16 by way of line 32. Accordingly, each time a lobe on the timing cam 26 is detected, a pulse is provided on output line 34 to coil 24. Coil 24, upon receiving a pulse on line 34, provides a high voltage firing pulse to the distributor 36 by high tension line 38. The distributor 36 distributes the high voltage firing pulses to the appropriate spark plug in accordance with the firing order of the internal combustion engine.

Figure 2:
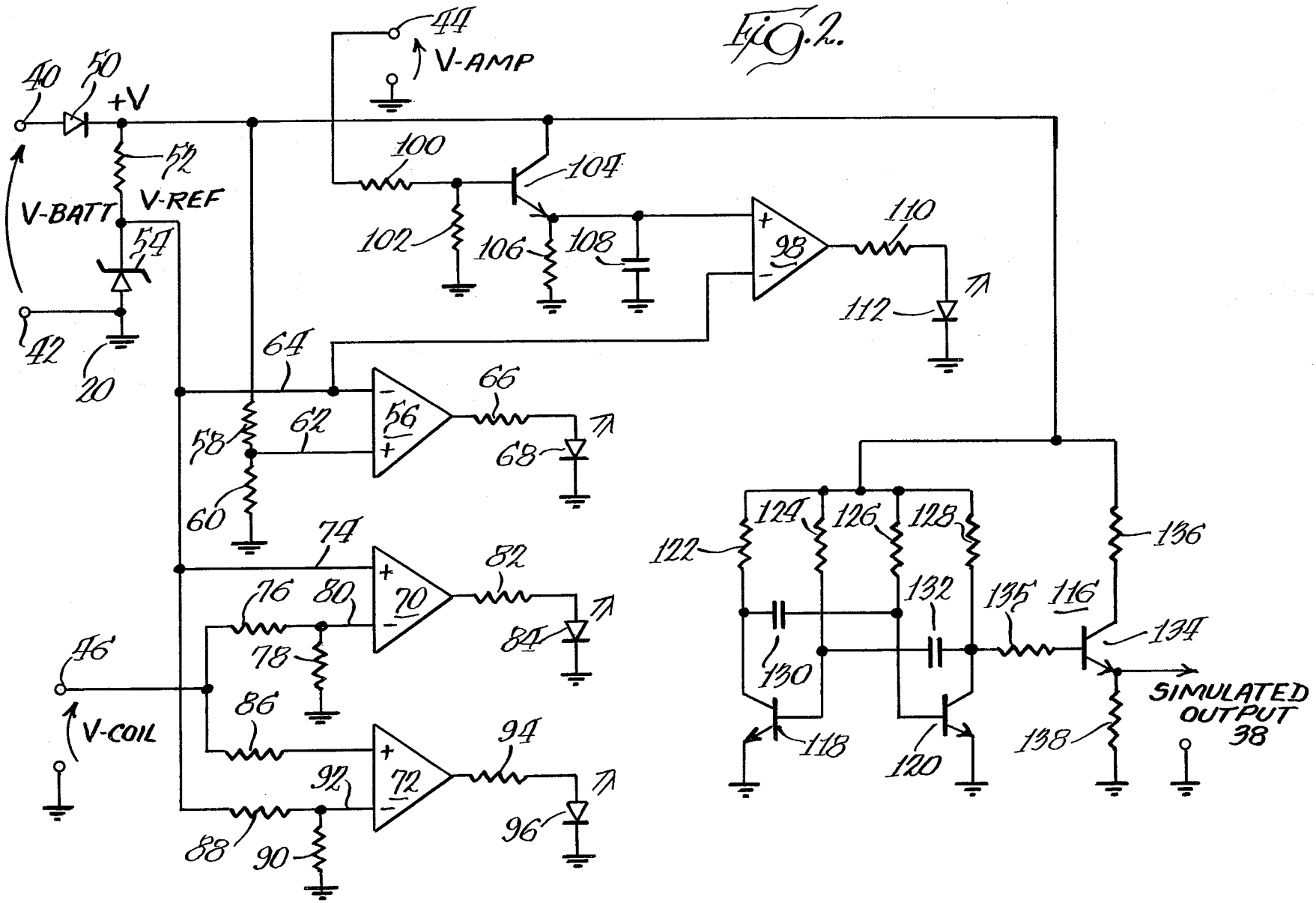
FIG. 2 is a schematic diagram of the instrument for testing the breakerless ignition system as shown in FIG. 1.

A preferred form of the circuit for testing the breakerless ignition system of FIG. 1 is shown in FIG. 2. In describing the circuit, various component values will be given. It is to be understood that this specific information is included solely as an example of an operative circuit, and any changes and modifications therefrom will be apparent to those skilled in the art. The instrument is connected to the breakerless ignition system in the following manner. Terminal 40 is coupled to the positive terminal of battery 10 and terminal 42 is connected to ground 20. Terminal 44 is coupled to line 34 to receive the output pulses V-AMP provided to coil 24. Terminal 46 is connected to the battery side of coil 24 to acquire the DC voltage provided to coil 24. Battery 10 is the power supply to the instrument during testing. Simulated output terminal 48 provides pulses which simulate the signal received from the magnetic sensor 30 as the timing cam 26 rotates, as will be explained in greater detail below.

Voltage from battery 20 is provided to the instrument through diode 50, IN4001, and provides polarity reversal detection in the event that the terminals 40 and 42 are improperly connected to battery 10 by the mechanic. Diode 50 is coupled through resistor 52, 1.8K, and zener diode 54, IN 5234, to ground 20. Hence, a voltage +V is established between the cathode of the diode 50 and the resistor 52, which voltage is proportional to the voltage of battery 10. A reference voltage V-REF is established between resistor 52 and zener diode 54. The value of the reference voltage V-REF is constant so long as the voltage from battery 10 exceeds the breakdown of the zener diode 54. Although V-REF may be selected at any value for the system disclosed herein, V-REF is established at 6.2 volts.

Operational amplifier 56 makes a voltage comparison to determine if the voltage provided by battery 10 is sufficient to operate the breakerless ignition system. Specifically, voltage +V is provided to the resistance divider consisting of resistor 58, 10K ohms, and resistor 60, 15K ohms. The positive input to the operational amplifier 56 is provided with the voltage across resistor 60 by line 62. The voltage on line 62 is directly proportional to the voltage provided by battery 10. The negative terminal of the operational amplifier 56 is provided with V-REF by line 64. If the voltage proportional to the battery voltage on line 62 exceeds V-REF on line 64, operational amplifier 56 provides current through limiting resistor 66, 470 ohms, to light-emitting diode (L.E.D.) 68, 5082–4850. Current through light-emitting diode 68 causes it to emit light indicating that the voltage from battery 10 is sufficient. In the circuit shown, a battery voltage greater than 11 volts is required to provide a voltage across resistor 60 which is sufficient to overcome the reference voltage V-REF on line 64. Any particular voltage may be selected by the appropriate selection of resistors 58 and 60.

The proper operation of the breakerless ignition system shown in FIG. 1 requires that the DC voltage provided to coil 24, V-COIL, be within a specified range. If V-COIL is less than an established level, as 4.9V, coil 24 may be shorted. On the other hand, if V-COIL is greater than a second established voltage, as 7.9V, a circuit component in amplifier module 16 may be defective. Operational amplifiers 70 and 72 determine if V-COIL 46 is within an established range. Specifically, operational amplifier 70, LM 324, is provided with V-REF on line 74 to its positive input terminal. Terminal 46 is coupled to a voltage divider consisting of resistor 76, 33K ohms, and resistor 78, 120K ohms. The voltage across resistor 78 is proportional to the voltage at terminal 46 and is provided to the negative input terminal of operational amplifier 70 by way of line 80. If the voltage across resistor 78 is less than V-REF, current is provided on the output of the operational amplifier 70 through resistor 82 to light-emitting diode (L.E.D.) 84,–4850, causing it to emit light. In the circuit shown, the voltage received at terminal 46 must be less than 7.9 volts for operational amplifier 70 to provide an output current to cause L.E.D. 84 to light. Operational amplifier 70, LM 324 is provided with the voltage from terminal 46 through limiting resistor 86 to its positive input terminal. The reference voltage V-REF is provided to a voltage divider consisting of resistor 88, 18K, and resistor 90, 47K. The voltage across resistor 90 is provided to the negative input terminal of operational amplifier 72 by line 92. The voltage across resistor 90 is proportional to V-REF, and if the voltage at the positive input terminal of the operational amplifier 72 exceeds the voltage across resistor 90, current is provided on the output through resistor 94, 470 ohms, to light-emitting diode (L.E.D.) 96, 5082–4850, causing it to emit light. In the circuit shown, the values of resistors 88 and 90 are selected so that an output current from operational amplifier 72 is provided to L.E.D. 96 when the voltage V-COIL at terminal 46 exceeds 4.9 volts.

Amplifier module 16 (FIG. 1), which is operating in a satisfactory manner, provides output pulses V-AMP to coil 24, which pulses are of minimum amplitude. The pulses from the amplifier module 16 are of an amplitude sufficient to provide the appropriate spark to the spark plugs 28. A determination regarding the sufficiency of the pulse amplitude of the output pulses V-AMP is made by operational amplifier 98. Specifically, terminal 44 is connected to resistor 100, 33K ohms, and resistor 102, 1K ohms. The voltage across resistor 102 is applied to the base of transistor 104, 2N3904. The collector of transistor 104 is coupled to voltage +V and the emitter thereof is coupled to resistor 106, 1M ohm, and capacitor 108, 0.05 microfarads. The resistor 106 and the capacitor 108 are coupled to the positive input terminal of the operational amplifier 98. When a pulse of sufficient amplitude is received in terminal 44, a voltage is developed across resistor 102 turning transistor 104 on. The on condition of transistor 104 supplies the voltage +V to the resistor-capacitor combination of resistor 106 and capacitor 108. The voltage at the positive terminal of the operational amplifier 98, therefore, builds as the voltage across the capacitor 108 charges. When the voltage at the positive terminal of the operational amplifier 98 exceeds V-REF on the negative input terminal, current is provided on the output of operational amplifier 98 through resistor 110, 470 ohms, and light-emitting diode (L.E.D.) 112, causing it to emit light. Transistor 104 remains on for the length of time that the pulse is provided to its base. Thus, if the pulse is of sufficient amplitude and transistor 104 remains on for a sufficient length of time, the voltage to capacitor 108 builds, causing the voltage at the positive input terminal of operational amplifier 98 to exceed the voltage at the negative input terminal. Capacitor 108 then holds a charge for some amount of time so that L.E.D. 112 may remain lit long enough to be seen. Resistor 106 discharges capacitor 108.

It is often required that the magnetic sensor 30 (FIG. 1) be substituted to assure that pulses are provided to the amplifier module 16 by line 32 as the timing cam 26 rotates. A check may be made by synthesizing the signal from the sensor. Accordingly, line 32 from the magnetic sensor to the amplifier module 16 is broken and the tester is coupled to line 32 at terminal 48. The tester provides a series of pulses which simulate the operation of the magnetic sensor 30 as the timing cam 26 rotates. Multivibrator, generally shown at 114, drives an emitter-follower circuit 116 to provide the simulated output pulses on terminal 38 of the tester. Multivibrator 114 is of the standard type and includes matching transistors 118 and 120, both 2N3904, resistors 122 (1K ohms), 124 (10K ohms), 126 (10K ohms) and 128 (1K ohms), as well as capacitors 130 and 132, both 0.33 $\mu$ fd. The values of the resistors and capacitors are selected to provide the appropriate pulses at the collector of transistor 120. The pulses from multivibrator 114 are provided to the base of transistor 134 through limiting resistor 135, 4.7K ohms. Upon the presence of a pulse to the base of transistor 134, transistor 134 is rendered conductive. Thus, the voltage +V is provided through resistors 136, 470 ohms, and 138, 100 ohms. The output of the emitter-follower circuit 116 is taken from the emitter of transistor 134 and hence the voltage developed across resistor 138 is provided to terminal 48. For an internal combustion engine having a breakerless ignition system of the type contemplated by this invention, the synthesized output pulse on line 38 has an amplitude of 2 volts peak.

A method of testing the breakerless ignition system of FIG. 1 by the use of the instrument shown in FIG. 2 will now be described. The method will be explained with reference to FIG. 3, which shows the correct condition of the various L.E.D.'s during different tests of the system. With the instrument connected to the system in the manner described above, the ignition switch 12 is turned to the OFF position, and a load is placed on the battery 10. The load may be provided by, for example, turning on the vehicle's lights. L.E.D. 68 will indicate whether the battery is of sufficient potential to operate the breakerless ignition system. L.E.D. 84 being on indicates that the DC voltage to coil 24 is not excessive.

The ignition switch 12 is then switched to ON and light-emitting diode 96 is observed to assure that sufficient voltage (i.e., greater than 4.9 volts) appears at coil 24. A satisfactory condition of the breakerless ignition system occurs when L.E.D. 68, L.E.D. 84 and L.E.D. 96 are on. This condition assures that there is sufficient battery voltage to the system and that the DC voltage, V-COIL, is sufficient, but not excessive.

The ignition switch 12 is then turned to START position to crank the internal combustion engine and L.E.D. 96 and L.E.D. 112 are observed. A normal condition exists if both L.E.D. 96 and L.E.D. 112 are on. This condition assures that the DC voltage, V-COIL, is sufficient during cranking and that the output pulses, V-AMP, are of sufficient amplitude to sustain a spark by spark plugs 28. When the internal combustion engine starts and the ignition switch 12 is returned to ON, all the light-emitting diodes should be on if the engine is running.

During the above tests, indications may appear that differ from those described. This is usually attributed to a faulty component or an intermittent within the wiring harness. Also, if the internal combustion engine does not start and the appropriate L.E.D. indications are not shown, the magnetic sensor 30 should be simulated. To determine whether magnetic sensor 30 is operating properly and to determine whether the amplifier module 16 is responsive to the pulses received from the magnetic sensor 30, line 32 is disconnected from the magnetic sensor 26 and coupled to terminal 48 of the instrument. Also, the high tension line 38 should be disconnected from the distributor 36 so that pulses are not provided to the spark plugs 28. The proper operation of the system is indicated by L.E.D. 68, L.E.D. 96 and L.E.D. 112 being on. This indication assures that the battery voltage is sufficient, that the DC voltage to the coil, V-COIL, is sufficient, and that the output pulses V-AMP, are of a width to sustain a spark.

Upon completion of the test, the instrument is removed from the breakerless ignition system.

We claim:

1. An instrument for testing a breakerless ignition system of an internal combustion engine having a battery, an ignition switch, an amplifier module, a coil, a distributor and spark plugs, the amplifier module providing a DC voltage to the coil and output pulses to the coil in response to rotation of a timing cam, the coil providing high voltage pulses to the distributor which distributes the high voltage pulses to the spark plugs comprising:

a first connecting means coupled to the battery;

means for establishing a reference voltage coupled to the first connecting means;

means coupled to said means for establishing a reference voltage and to the battery for comparing the reference voltage to the voltage provided by the battery;

means coupled to said means for comparing the reference voltage to the voltage provided by the battery for indicating whether the voltage provided by the battery exceeds the reference voltage;

a second connecting means coupled to the coil;

means coupled to said coil for comparing the DC voltage provided to the coil to a first and a second established voltage;

means coupled to said means for comparing the DC voltage provided to the coil to a first and a second established voltage for indicating whether the DC voltage provided to the coil is greater or less than the first established voltage;

means coupled to said means for comparing the DC voltage provided to the coil to a first and a second established voltage for indicating whether the DC voltage provided to the coil is greater or less than the second established voltage;

means coupled to said coil for determining the amplitude of the output pulses to the coil; and means coupled to said means for determining the amplitude of the output pulses to the coil for indicating whether the amplitude of the output pulses exceeds an established voltage reference.

2. The instrument as claimed in claim 1 further including:

means coupled to said amplifier module for simulating a signal representative of a signal obtained by the rotation of the timing can.

3. The instrument as claimed in claim 1 wherein the means for establishing the reference voltage includes:

a diode connected to the first connecting means;

a resistor coupled to the diode; and a zener diode connected to the resistor and to ground so that the reference voltage is provided at the junction of the zener diode and the resistor.

4. The instrument as claimed in claim 1 wherein the means for comparing the reference voltage and indicating whether the voltage provided by the battery exceeds the reference voltage includes:

an operational amplifier having a first and a second input and an output, the reference voltage provided to the first input thereof;

a voltage divider connected to the second input thereof for providing a voltage proportional to the battery voltage; and the output of the operational amplifier coupled to an indicator which indicates whether the voltage provided by the battery exceeds reference voltage.

5. The instrument as claimed in claim 1 wherein the means for comparing the DC voltage provided to the coil include:

a first operational amplifier having a first and a second input and an output, the first input coupled to the reference voltage;

a voltage divider coupled to the second input of the first operational amplifier for providing a voltage proportional to the DC voltage provided to the coil so that a first current is provided on the output of the operational amplifier to said indicating means if the DC voltage provided to the coil is less than the reference voltage;

a second operational amplifier having a first and a second input and an output, the first input provided with the DC voltage provided to the coil; and a voltage divider coupled to the second input of the second operational amplifier for providing the second input with a voltage proportional to the reference voltage so that a second current is provided on the output of the second operational amplifier to said indicating means when the voltage provided to the coil exceeds the voltage provided to the second input of the second operational amplifier.

6. The instrument as claimed in claim 5 wherein the reference voltage is 6.2 volts and the first established voltage is equal to 7.9 volts.

7. The instrument as claimed in claim 5 wherein the reference voltage is 6.2 volts and the second established voltage is equal to 4.9 volts.

8. The instrument as claimed in claim 1 wherein the means for determining the pulse amplitude of the output pulses from the amplifier to the coil include:

an operational amplifier having a first and a second input and an output;

a resistor and a capacitor coupled to the first input of the operational amplifier;

a transistor having a base, emitter and collector, the base of the transistor connected to a voltage divider which provides a voltage proportional to the output pulses from the amplifier, said transistor being on during the presence of an output pulse, the collector and the emitter of the transistor so connected that a voltage is applied across the resistor and capacitor while the transistor is on;

the second input of the operational amplifier connected to the reference voltage, the output of the operational amplifier providing a current if the voltage on the first input of the operational amplifier exceeds the reference voltage.

9. The instrument as claimed in claim 2 wherein the means for synthesizing a signal representative of the rotation of the timing cam includes:

a multivibrator for providing simulated pulses;

an emitter follower circuit coupled to said multivibrator, said emitter follower responsive to said simulated pulses to provide simulated output pulses.

10. The instrument as claimed in claim 1 wherein the means for indicating the voltage provided by the battery exceeds a reference is a light-emitting diode.

11. The instrument as claimed in claim 1 wherein the means for including whether the DC voltage provided to the coil is greater or less than a first established voltage includes a light-emitting diode.

12. The instrument as claimed in claim 1 wherein the means for indicating whether the DC voltage provided to the coil is greater or less than the second established voltage includes a light-emitting diode.

13. The instrument as claimed in claim 1 wherein the means for indicating whether the amplitude of the output pulse exceeds an established voltage reference includes a light-emitting diode.

14. An instrument for testing a breakerless ignition system of an internal combustion engine having a battery, an ignition switch, an amplifier module, a coil, a distributor and spark plugs, the amplifier module providing a DC voltage to the coil and output pulses to the coil in response to rotation of a timing cam, the coil providing high voltage pulses to the distributor which distributes the high voltage pulses to the spark plugs comprising:

a first connecting means coupled to the battery;

means for establishing a reference voltage coupled to the first connecting means, said means for establishing a reference voltage including a diode connected to the first connecting means, a resistor coupled to the diode, and a zener diode connected to the resistor and to ground so that the reference voltage is provided at the junction of the zener diode and the resistor;

means for comparing the reference voltage to the voltage provided by the battery, said means for comparing the reference voltage including a first operational amplifier having a first and a second input and an output, the reference voltage provided to the first input thereof, said means for comparing the reference voltage including a voltage divider connected to the second input thereof for providing a voltage proportional to the battery voltage;

means for indicating whether the voltage provided by the battery exceeds the reference voltage wherein said indicating means includes an indicator responsive to the output of the first operational amplifier to indicate whether the voltage provided by the battery exceeds the reference voltage;

a second connecting means coupled to the coil;

means for comparing the DC voltage provided to the coil to a first and a second established voltage, said means for comparing the DC voltage including a second operational amplifier having a first and a second input and an output, the first input coupled to the reference voltage, a voltage divider coupled to the second input of the second operational amplifier for providing a voltage proportional to the DC voltage provided to the coil, a third operational amplifier having a first and a second input and an output, said first input provided with the DC voltage provided to the coil, a voltage divider coupled to the second input of the third operational amplifier for providing the second input with a voltage proportional to the reference voltage;

means responsive to the outputs of the second and third operational amplifiers for indicating whether the DC voltage provided to the coil is greater than or less than the first and second established voltages, said means for indicating being two light-emitting diodes each coupled to the output of the second and third operational amplifiers;

means for determining the amplitude of the output pulses to the coil, said means for determining including a fourth operational amplifier having a first and a second input and an output, a resistor and a capacitor coupled to the first input of the fourth operational amplifier, a transistor having a base, emitter and collector, the base of the transistor connected to a voltage divider which provides a voltage proportional to the output pulses from the amplifier module, said transistor being on during the presence of an output pulse, the collector and the emitter of the transistor so connected that a voltage is applied across the resistor and capacitor while the transistor is on, the second input of the fourth operational amplifier connected to the reference voltage;

means responsive to the output of said fourth operational amplifier for indicating whether the amplitude of the output pulse from the amplifier module exceeds an established voltage reference, said means for indicating being a light-emitting diode; and means coupled to said amplifier module for simulating a signal representative of a signal obtained by the rotation of the timing cam, said means for simulating including a multivibrator for providing simulated pulses, an emitter follower circuit coupled to said multivibrator, said emitter follower responsive to said simulated pulses to provide simulated output pulses.

15. A method of testing a breakerless ignition system for an internal combustion engine having a battery coupled to an ignition system, an amplifier module, a coil, a distributor and spark plugs, the amplifier module providing a DC voltage to the coil and output pulses to the coil in response to a rotation of a timing cam, the coil providing high voltage pulses to the distributor which distributes the high voltage pulses to the spark plugs comprising:

positioning the ignition switch to an off position;

comparing the voltage of the battery to a first established voltage level;

indicating if said voltage of the battery is greater than the first established voltage level;

comparing the DC voltage to the coil to a second established voltage level;

indicating if the DC voltage to the coil is less than the second established value;

positioning the ignition switch to an on position;

comparing the DC voltage to the coil to a third established voltage level;

indicating if the DC voltage to the coil is greater than the third established level;

positioning the ignition switch to a start position;

comparing the DC voltage to the coil to the third established level;

indicating if the DC voltage to the coil is greater than the third established level;

comparing the amplitude of the pulses to the coil in response to the rotation of the timing cam to a predetermined amplitude;

indicating if said pulses to the coil are greater than the predetermined amplitude; and positioning the ignition switch to the run position.

16. The method of testing a breakerless ignition system as claimed in claim 15 further including:

comparing the amplitude of the pulses to the coil to the predetermined amplitude in response to the simulated rotation of the timing cam.

* * * * *